US005960975A

United States Patent [19]

Lennartsson

[11] Patent Number: 5,960,975

[45] Date of Patent: Oct. 5, 1999

[54] PACKAGING MATERIAL WEB FOR A SELF-SUPPORTING PACKAGING CONTAINER WALL, AND PACKAGING CONTAINERS MADE FROM THE WEB

[75] Inventor: Mattias Lennartsson, Lund, Sweden

[73] Assignee: Tetra Laval Holdings & Finance S.A., Pully, Switzerland

[21] Appl. No.: 08/820,944

[22] Filed: Mar. 19, 1997

[30] Foreign Application Priority Data

Apr. 1, 1996 [SE] Sweden ..... 9601260

[51] Int. Cl.[6] ..... B65D 5/62

[52] U.S. Cl. ..... 220/62.22; 383/3; 220/666; 220/675; 215/12.1; 215/382

[58] Field of Search ..... 383/3; 428/178, 428/188, 167, 172; 220/666, 6, 4.28, 904, 62.22, 62.11, 720, 721, 592.27, 672, 670, 675; 215/383, 382, 384, 13.1, 12.1

[56] References Cited

U.S. PATENT DOCUMENTS

| | | | |
|---|---|---|---|
| 2,414,801 | 1/1947 | Clarke | 175/366 |
| 2,651,314 | 9/1953 | Hasselquist | 206/522 |
| 2,874,826 | 2/1959 | Matthews | 206/522 |
| 3,164,186 | 1/1965 | Weber et al. | 383/3 |
| 3,205,936 | 9/1965 | Katz | 165/80 |
| 3,207,420 | 9/1965 | Navarrete-Kindelan . | |
| 3,372,733 | 3/1968 | Callender | 165/1 |
| 3,388,739 | 6/1968 | Olson et al. | 165/80 |
| 3,413,532 | 11/1968 | Boyer | 317/235 |
| 3,456,860 | 7/1969 | Janninck | 215/12.1 |
| 3,457,988 | 7/1969 | Meyerhoff et al. | 165/80 |
| 4,044,867 | 8/1977 | Fisher | 383/3 |
| 4,141,030 | 2/1979 | Eisele et al. | 357/79 |
| 4,340,902 | 7/1982 | Honda et al. | 357/74 |
| 4,345,267 | 8/1982 | Corman et al. | 357/81 |
| 4,396,935 | 8/1983 | Schuck | 357/74 |
| 4,404,582 | 9/1983 | Pollard et al. | 357/79 |
| 4,471,837 | 9/1984 | Larson | 165/185 |

(List continued on next page.)

FOREIGN PATENT DOCUMENTS

| | | | |
|---|---|---|---|
| 1 279 557 | 11/1961 | France | 215/13.1 |
| 525665 | 6/1931 | Germany | 21/11 |
| 2 605 123 | 8/1977 | Germany | 220/666 |
| 625657 | 7/1949 | United Kingdom . | |
| 1217148 | 12/1970 | United Kingdom . | |

OTHER PUBLICATIONS

Akira Suzuki; Abstract; Manufacture of Heat Sink for Semiconductor; Patent No. 54–25168.

Kaoru Tachibana; Abstract; Semiconductor Device; Patent No. 4–72747.

*Primary Examiner*—Stephen Castellano
*Attorney, Agent, or Firm*—Burns, Doane, Swecker & Mathis, L.L.P.

[57] ABSTRACT

A packaging material web for a self-supporting packaging container wall which includes a number of continuous wall panels manufactured from flexible material layers which are interconnected with one another by means of a pattern of seals. Between the seals, there are formed cells which are inflatable with a view to imparting to the material the requisite rigidity. A packaging container manufactured from the packaging material comprises a number of wall panels provided with inflatable cells, the length of the wall panels on inflation of the cells being reduced so that the height of the packaging container shrinks. Along one of the vertical side edges of the packaging container, there is a sealing joint (10) which is less flexible and counteracts such shrinkage so that the packaging container tends to be warped. In order to counteract this, the seals defining the cells are given asymmetric form, with one narrow and one broad end. The narrow end of the seals is turned to face towards the sealing joint (10) and the interjacent cells will hereby have ends of varying size, which corrects the shrinkage of the material such that the effect of the sealing joint (10) is reduced and the packaging container obtains the desired, symmetric form.

13 Claims, 2 Drawing Sheets

U.S. PATENT DOCUMENTS

| | | | |
|---|---|---|---|
| 4,535,384 | 8/1985 | Wakabayashi et al. | 361/386 |
| 4,551,379 | 11/1985 | Kerr . | |
| 4,563,725 | 1/1986 | Kirby | 361/388 |
| 4,587,550 | 5/1986 | Matsuda | 357/79 |
| 4,729,061 | 3/1988 | Brown | 361/386 |
| 4,801,213 | 1/1989 | Frey et al. | 383/3 |
| 4,803,546 | 2/1989 | Sugimoto et al. | 357/81 |
| 4,849,857 | 7/1989 | Butt et al. | 361/388 |
| 4,890,194 | 12/1989 | Derryberry et al. | 361/386 |
| 4,941,067 | 7/1990 | Craft | 361/386 |
| 4,996,629 | 2/1991 | Christiansen et al. | 361/400 |
| 5,012,386 | 4/1991 | McShane et al. | 361/386 |
| 5,172,301 | 12/1992 | Schneider | 361/386 |
| 5,227,663 | 7/1993 | Patil et al. | 257/718 |
| 5,263,587 | 11/1993 | Elkin et al. | 206/522 |
| 5,293,930 | 3/1994 | Pitasi | 165/80.3 |
| 5,470,016 | 11/1995 | Ljungström et al. . | |
| 5,489,464 | 2/1996 | Björck . | |
| 5,741,573 | 4/1998 | Malm . | |

PACKAGING MATERIAL WEB FOR A SELF-SUPPORTING PACKAGING CONTAINER WALL, AND PACKAGING CONTAINERS MADE FROM THE WEB

TECHNICAL FIELD

The present invention relates to a packaging material web for a self-supporting packaging container wall comprising a number of continuous wall panels each one of which including flexible material layers which are interconnected with one another in a pattern of seals distributed over the surface area of the layers, the seals between them dividing up a chamber defined by the layers into patterns of mutually interconnected, substantially elongate and inflatable cells. The present invention also relates to a packaging container with a self-supporting packaging container wall comprising a number of continuous wall panels, each one of which including flexible material layers which are interconnected with one another in a pattern of seals distributed over the surface area of the layers, the seals between them dividing a chamber defined by the layers into a pattern of mutually interconnected, substantially elongate cells which are filled with gas at excess pressure.

BACKGROUND ART

Consumer packages for, for example, liquid or pumpable foods are often manufactured from web or sheet-shaped material. The material may be a plastic film or a packaging laminate which includes layers of different material types. At least one surface layer of the packaging material often consists of thermoplastic which, on the one hand, ensures the liquid-tightness of the material and, on the other hand, makes it possible to thermoseal the material to itself in liquid-tight fashion. A packaging material may also be given satisfactory tightness against both gas and liquid penetration with the aid of thin layers of so-called barrier plastics, for example ethyl vinyl alcohol (EVAL). Different methods may be employed in order to ensure that the material obtains self-supporting properties, i.e. displays sufficient rigidity to be usable for the manufacture of configurationally stable, e.g. parallelepipedic, packaging containers. The material may, for example, include a layer of flexurally rigid material, for example paperboard or metal, or be given the desired rigidity in that the layers which are included in the material and which per se are of flexible plastic material may, with the aid of, for example gas (normally air), be kept at such mutual spaced apart relationship that so-called bulkhead effect is achieved.

A number of variations of the above-mentioned packaging material types are known in the art, and one packaging laminate whose flexural rigidity is achieved with the aid of gas-filled cells acting as spacers is disclosed and described, e.g. in European Patent Application EP 94105450.4. The packaging laminate disclosed in this publication comprises a chamber defined between the laminate layers, the chamber being divided by means of a number of linear, substantially parallel seals, into a large number of inflatable cells. The cells, which extend substantially horizontally over the walls of the finished packaging container, keep the material layers included in the laminate at such spaced apart relationship from one another that the previously mentioned bulkhead effect is achieved, which, despite the absence of conventional rigidifying material layers, results in a configurationally stable packaging container possessing superior rigidity. The packaging container is substantially paralelepipedic with a number of continuous wall panels which, along a vertical edge of the packaging container, are united in a liquid-tight, longitudinal sealing joint. When the cells of the packaging laminate are filled with gas, a contraction of the material takes place, with the result that the height of the finished packaging container is less than the height (length) of corresponding packaging material in the deflated state. The height loss which takes place when the individual cells are filled with gas is, however, counteracted at the vertical corner of the packaging container, where the sealing joint is located, with the result that the packaging container has gently curved configuration. Attempts to make the sealing joint narrower in order thereby to reduce its obstructive effect on the shrinkage of the material in connection with its inflation have only been partially successful and there is thus a need in the art to provide an arrangement which greatly reduces or wholly obviates the above mentioned drawback and results in the packaging container having, in the inflated "finished" state, uniformly high vertical edges and thereby a straight, symmetric (e.g. parallelepipedic) appearance.

OBJECTS OF THE INVENTION—THE MATERIAL WEB

One object of the present invention is thus to realise an arrangement which obviates the above-mentioned drawbacks and makes for the production of symmetric, parallelepipedic packaging containers from a packaging laminate with rigidifying, inflatable cells.

A further object of the present invention is to realise a packaging material web of such design that the packaging material, on inflation, compensates for the presence of sealing joints, joint panels or other irregularities which affect geometric configuration.

Still a further object of the present invention is to realise a packaging material web with wall panels of elongate, inflatable cells whose form is such that the material, when reformed into a packaging container, makes it possible to impart thereto symmetric configuration, regardless of the presence of sealing joints.

SOLUTION

These and other objects have been attained according to the present invention in that a packaging material web of the type disclosed by way of introduction has been given the characterizing feature that a number of the seals in one wall panel have substantially the same orientation and display one narrow and one broad end. Preferred embodiments of the packaging material web according to the invention have further been given the characterizing features as set forth in appended subclaims 2 to 7.

OBJECTS OF THE INVENTION—THE PACKAGING CONTAINER

A further object of the present invention is also to realise a packaging container with self-supporting, inflatable packaging material walls which, despite the presence of a sealing joint panel joined in a sealing joint, retains a straight, symmetric configuration in the inflated state.

Still a further object of the present invention is to realise a packaging container which does not suffer from the drawbacks inherent in prior art packaging containers of this type, but may be given a desired, predeterminable configuration without any design constructions which render the packaging container more expensive or which reduce its quality.

Yet a further object of the present invention is to realise a packaging container in which the presence of a sealing joint may be compensated for in such a manner that, in the finished state, the packaging container displays vertical edges of substantially the same length.

SOLUTION

The above and other objects have been attained according to the present invention in that a packaging container of the type described by way of introduction has been given the characterizing features that a number of the cells within one wall panel are substantially uniformly oriented and have a large and a small circumference.

Preferred embodiments of the packaging container according to the present invention have further been given the characterizing features as set forth in appended subclaims 9 and 10.

ADVANTAGES

By designing the cells or the seals between the cells with one broad and one narrow end, the shrinkage caused by inflation of the material is affected such that it counteracts the obstructive effects of the sealing joint panel (the sealing joint), which results in a packaging material web and a packaging container with the desired, predeterminable appearance. More precisely, the material shrinkage is reduced at those ends of the seals which have greater width, an effect that may be selected so that it entirely compensates for the presence of the sealing joint and the effects it has.

BRIEF DESCRIPTION OF THE ACCOMPANYING DRAWINGS

Preferred embodiments of the both the packaging material web and the packaging container according to the present invention will now be described in greater detail hereinbelow, with particular reference to the accompanying, schematic Drawings, which show only those details essential to an understanding of the present invention. In the accompanying Drawings.

DESCRIPTION OF PREFERRED EMBODIMENT

Figure 1:
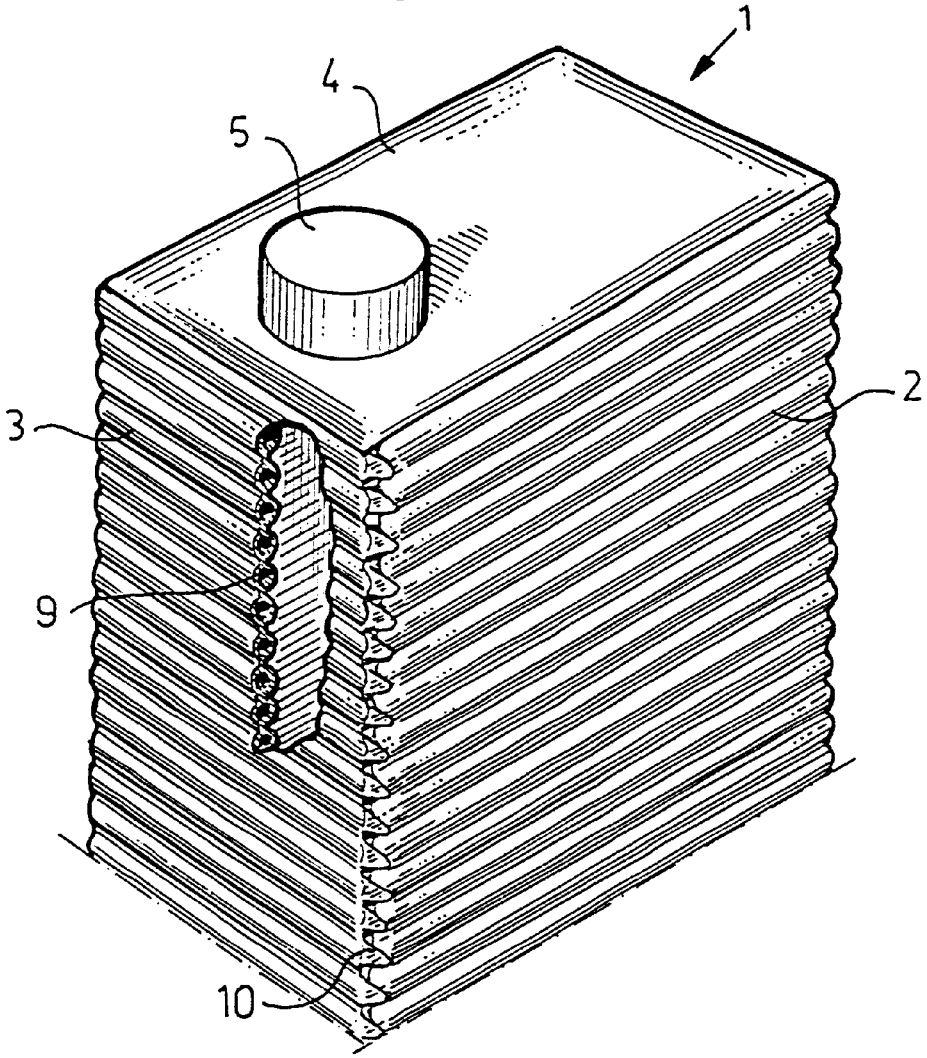
FIG. 1 shows in perspective and partly in cross section an upper region of a packaging container according to the present invention.

The packaging container illustrated in FIG. 1 is of the same main type as the packaging container which is described in European Patent Application EP 94105450.4, to which reference is now made for further information in respect of not only package, but also packaging material and production method. The packaging container 1 is substantially parallelepipedic with two mutually parallel main wall panels 2, two mutually parallel side wall panels 3 and a lower (not shown) and an upper end wall 4. The upper end wall also includes an opening arrangement 5 in the form of, for example, a holed pouring aperture with a conventional screw cap. In order to reduce material requirements, and in particular the need for a separate, rigidifying layer, at least the wall panels 2 and 3 of the packaging container are manufactured from two or more layers of flexible plastic material, for example thermoplastic material such as polyethylene in order to make for superior thermosealing, as well as included layers for improving the material's gas and liquid tightness, for example various types of barrier materials such as ethyl vinyl alcohol or aluminum foil (Alifoil). It is apparent from FIG. 2 how the packaging material includes, for example, an outer, first material layer 6 and an inner, second material layer 7 which are interconnected to one another by means of elongate seals 8. The space between the two material layers forms a continuous chamber which is defined by means of seals in such a manner that it extends over the greater portion of the packaging container, or in any event its main wall panels 2 and 3. The chamber is divided by means of the elongate, linear seals 8, into a large number of substantially elongate and inflatable cells 9. When the chamber is filled in a suitable manner with gas or air at excess pressure, the two material layers 6 and 7 will automatically be kept in such spaced apart relationship from one another as the mutually sealed parts of the layers permit. Hereby, the cells 9 realised by the seals 8 will obtain substantially oval or circular cross sectional configuration.

As has been mentioned earlier, the packaging container 1 according to the invention is manufactured from a packaging material web 11 which, by means of transverse incisions, is divided into substantially rectangular packaging material blanks 12 (the expression "web" thus encompasses, in applicable cases, also one or more continuous packaging material blanks). Along the longitudinal edges 14 of the packaging material web 11, there are sealing joint panels 13 which, when they are sealed to one another, form the sealing joint 10, as will be described in greater detail hereinbelow. It will further be apparent from the Figure how the linear seals 8 are disposed in parallel over a symmetric pattern of the packaging material blank 12 in order to form the main wall panels 2 and side wall panels 3 which are disposed adjacent one another and together form the inflatable chamber consisting of the two material layers 6 and 7 and surrounding seals. The chamber is inflatable by means of, for example, chemical, gas-forming substances, or by connection to an external pressure source for the desired gas, e.g. air, as is described in-depth in the above-mentioned European Patent Publication, to which reference is now made.

Figure 3:
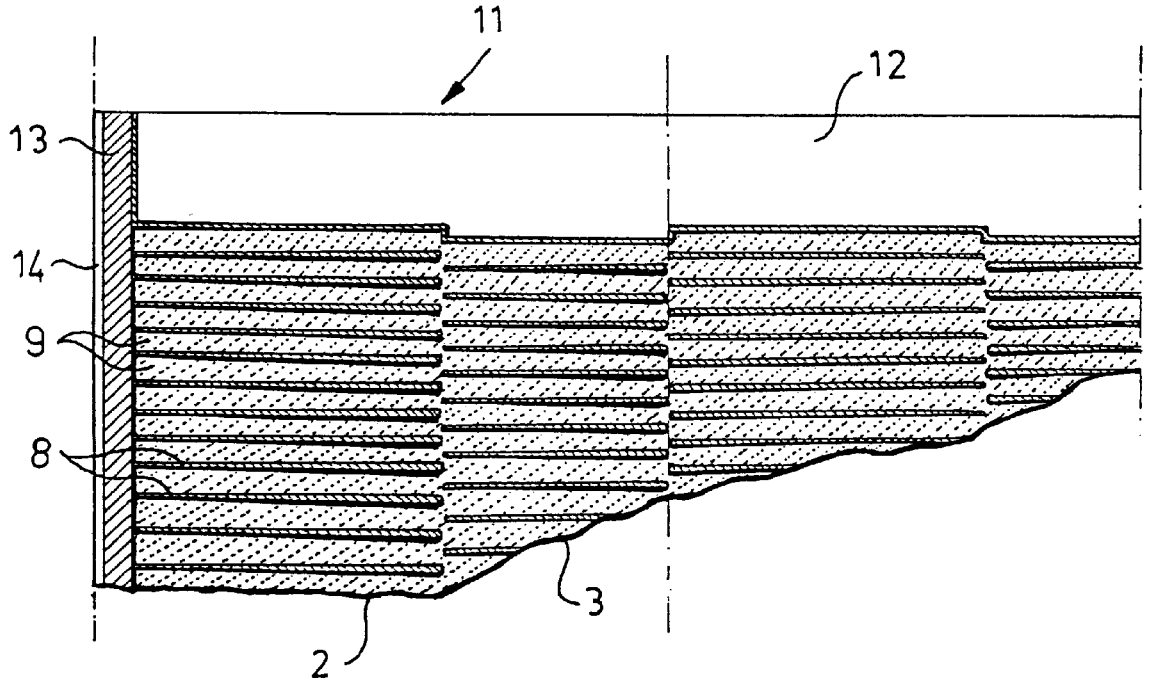
FIG. 3 shows a part of a packaging material web for the production of a packaging container according to FIG. 1.
Figure 4:
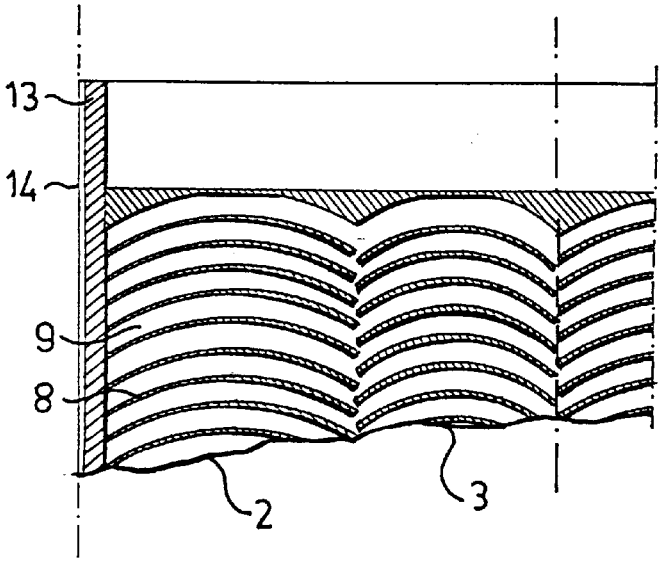
FIG. 4 shows a part of a packaging material web for producing a second type of packaging container according to the present invention.

Within each wall panel 2, 3, there are thus a relatively large number of substantially elongate seals, the majority of which have essentially the same orientation transversely of the longitudinal direction of the packaging material web 11, i.e. substantially at a right angle to the longitudinal edge 14 or joint panel 13 of the packaging material web 11. The expression "the same orientation" is here taken to signify that the cells/seals are more or less uniformly oriented in relation to the packaging container. Naturally however, not all cells/seals need to be of identical configuration or size in order to satisfy this requirement. In wall panels with cells/seals of varying configuration and orientation, the requirement may be considered to be satisfied when a certain grouping or orientation vis-à-vis the sealing joint panel 13 of the packaging container is discernible. The desired configuration and appearance of the packaging container, as well as the desired compensation are naturally those which will ultimately determine both the orientation and configuration of the seals. Each individual seal 8 in the two outer wall panels 2, 3 adjacent the joint panel 13 displays one narrow and one broad end, with the result that the outer contour of the seals, when the material is planar and the seals are in the straight state, is in the form of a very elongate triangle or a trapezium with slightly rounded corners. The seals 8 in the wall panels adjacent both longitudinal edges 14 of the material web 11 are oriented in such a manner that the ends of lesser width are located most proximal the edges. Other seals located between the central region of the material web and one of the joint panels are also oriented such that the ends of lesser width are turned to face the web edge, even though the tapering form of the seals 8 is less accentuated in the central region of the packaging material web 11 than at the two outer wall panels 2, 3. In smaller packaging containers, the seals 8 in the two central wall panels 3, 2 may possibly be symmetric, i.e. have the same width throughout their entire length. The seals which are employed in the packaging container according to FIG. 1 and in the blank for such packaging containers, which is illustrated in FIG. 3, are substantially straight and mutually parallel, but it is also possible to give these seals some other configuration, i.e. a curved configuration as illustrated in the packaging material blank 12 in FIG. 4 or an undulating form, angular form or arched form (not shown). Although the configuration of the seals 8 and thereby the cells 9 is of a certain importance for the rigidity of the packaging container (for example it is important that the major extent of the cells 9 is horizontal), the configuration of the cells may also be governed by aesthetic needs, which makes it possible to impart to the packaging container an individual, highly distinguished profile with simple means. The curved or undulating seals also have substantially the same orientation and display one narrow and one broad end. If the seals are seen as in the elongate or straight state, the seals in corresponding wall panels of for example the embodiment of the packaging material illustrated in FIG. 4 are also substantially elongate triangular or trapezoidal.

In packaging containers which are not to have a simple, straight or symmetric configuration, but instead arched or profiled "fantasy form", the seals may have varying orientation in order to impart to the packaging container the desired configuration and appearance. In order to achieve the desired flexural obstruction effect, a number of the seals within one wall panel must however have substantially the same orientation and also display one narrow and one broad end. In packages which are to be straight throughout their entire length or height, at least half of the seals will probably have to be of identical orientation and have one narrow and one broad end. For example, it is conceivable to design every other seal in this manner, or alternatively to group such seals and distribute them over a larger or smaller area of a wall panel.

When a packaging material web 11 according to FIG. 3 is reformed into a packaging container 1 according to FIG. 1, there first takes place a folding of the packaging material web or packaging material blank 12 into tube or hose form by both longitudinal edges 14 of the web being sealed to one another with the aid of the two sealing joint panels 13 which, after sealing of the material inside-to-inside, form the projecting sealing fin or sealing joint 10 (FIG. 1). The continued reforming of the packaging material blank 12 into finished packaging containers comprises sealing and forming of both substantially planar end walls 4 of the packaging container, as well as application of the opening arrangement 5. This may take place, for instance, in the per se known method which is described in the abovementioned European Patent Specification, or in any other previously known manner. The design and production of the end walls 4 and opening arrangement 5 of the packaging container are of no consequence to the present invention and will not, therefore, be described in greater detail here.

Figure 2:
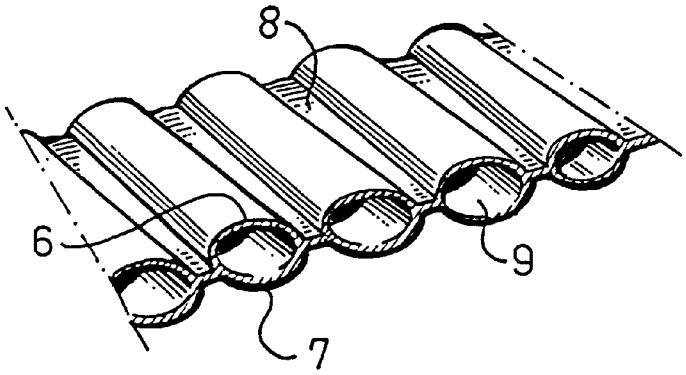
FIG. 2 shows, on a larger scale and in cross section, a part of a packaging container wall in the packaging container illustrated in FIG. 1.

On inflation of the chambers defined by the seals between the two material layers 6, 7 with air, the air is distributed simultaneously to all cells 9 in communication with one another, so that these, within each wall panel 2, 3 obtain the inflated form shown in FIG. 2, i.e. obtain a more or less circular or oval cross section. Since the two material layers 6 and 7 will, in such instance, obtain a "corrugated" form or undulating form, the total length of the material, i.e. the total height of the packaging container, will be reduced in connection with the inflation operation. At the vertical edge of the packaging container where the sealing joint 10 is located, this inflation and length change will be counteracted because of the increased rigidity of the mutually fused joint panels 13, and in order to prevent the packaging container from becoming warped, i.e. having a curved or sloping configuration, the length change in the remaining parts of the side and main wall panels 2, 3 must be corrected so that all vertical edges of the packaging container will have the same height when the packaging container has obtained its final form. Such correction is realised in that the seals 8 within two or more wall panels have, as was mentioned above, one narrow and one broad end, the seals being oriented such that the ends of lesser width are located most proximal the edges 14 or joint panels 13 of the packaging material web 11. The end of the cells facing away from the sealing joint 10 in the main wall panel 2 and side wall panel 3 adjacent the sealing joint 10 will thus, on inflation, be of lesser circumference, with the result that the length change of the material is reduced to such an extent as to compensate for the presence of the sealing joint 10.

In a packaging container of a typical size, e.g. of 0.5 liter volume which has four substantially equally wide wall panels 2, 3 (60 mm), each seal 8 will have a minimum width of approx. 1 mm and a maximum width at the opposite end of approx. 2 mm. This reduces the circumference at the end of the cells 9 facing away from the sealing joint to such an extent that these together (approximately 30 in number) fully compensate for the "shrinkage obstruction" effect of the sealing joint 10. In packaging containers of, for example, regular, square or rectangular cross section, it has proved sufficient if the two wall panels adjacent the sealing joint 10 are provided with this type of seal. Corresponding seals in other wall panels may thus be of the conventional type of uniform width. In packaging containers with greatly varying width relationships or in such as have irregular or asymmetric cross section, one or more of the other wall panels may, however, need to be designed with the relevant tapering type of seal 8 (but however with less marked width difference between the ends).

The expression "width of the seals" is normally taken to signify the width of the sealed region, but in those cases when the seal displays a central, unsealed surface (e.g. actual sealing only along the outer contour of a large sealing area), signifies the width of the outer contour of the area.

It is also possible that one or more of the wall panels of the packaging container are not planar but more or less curved or arched, and in such cases when the width or configuration of the seal 8 is discussed (as in arched or undulating seals 8/cells 9), their width or configuration in the straightened or straight/planar state is intended.

By providing the packaging material web/packaging container with asymmetric (narrow-broad) seals according to the present invention, compensation will be achieved in a simple, efficient manner for the deforming action of the sealing joint 10 so that the packaging containers may be manufactured with the desired, e.g. straight profile.

What is claimed is:

1. A packaging material web for a self-supporting packaging container wall comprising a plurality of continuous wall panels, each of which includes flexible material layers which are interconnected with one another in a pattern of seals distributed over the surface area of the layers, the seals between them dividing up a chamber defined by the layers into patterns of mutually interconnected, substantially elongate and inflatable cells, wherein a number of the seals within at least one wall panel have substantially the same orientation and display one narrow end and one broad end, wherein each of the seals has the flexible material layers interconnected across the entire width at all cross sections of the seal.

2. The packaging material web as claimed in claim 1, wherein the outer contour of the seals, when the seals are in a straight state, is substantially triangular or trapezoid.

3. The packaging material web as claimed in claim 1 wherein each of the wall panels includes a number of seals which are oriented at an angle to edges of the material web.

4. The packaging material web as claimed in claim 1, wherein seals adjacent two longitudinal edges of the material web are oriented such that the narrow ends of lesser width are located proximal the edges.

5. The packaging material web as claimed in claim 1 wherein seals located between a central region of the material web and one web edge are oriented such that the narrow ends of lesser width are turned to face towards said one web edge.

6. The packaging material web as claimed in claim 1, wherein the seals are substantially straight and mutually parallel.

7. The packaging material web as claimed in claim 1, wherein the seals are curved or undulating.

8. The packaging material web as claimed in claim 1, wherein said seals define a means for preventing curvature of a packaging container in an inflated state.

9. Packaging containers with a self-supporting packaging container wall comprising:

a number of continuous wall panels, each of which includes flexible material layers which are interconnected with one another in a pattern of seals distributed over the area of the layers, the seals between them dividing a chamber defined by the layers into a pattern of mutually interconnected, substantially elongate cells which are filled with gas at excess pressure, wherein a number of the cells within a wall panel are substantially uniformly oriented and have a large circumference at a first end and a small circumference at a second end, and a sealing joint uniting two wall panels and extending substantially vertically, said cells adjacent the sealing joint being oriented such that the larger first ends of the cells are turned to face towards the sealing joint.

10. The packaging container as claimed in claim 9, wherein a majority of the cells extends substantially horizontally.

11. The packaging container as claimed in claim 9, wherein each said cell gradually tapers from the first large circumference end to the second small circumference end.

12. The packaging container as claimed in claim 9, wherein said small circumference and said large circumference are defined about a central longitudinal axis of the cell.

13. The packaging container as claimed in claim 9, wherein said seals define a means for preventing curvature of the packaging container in an inflated state.

* * * * *